US006026954A

United States Patent [19]

Marsh

[11] Patent Number: 6,026,954

[45] **Date of Patent: *Feb. 22, 2000**

[54] TOOL TRAY FOR AUTOMOTIVE REPAIR

[76] Inventor: Daniel F. Marsh, 2481 Lakeshore Dr., Canyon Lake, Tex. 78133

[ * ] Notice: This patent issued on a continued prosecution application filed under 37 CFR 1.53(d), and is subject to the twenty year patent term provisions of 35 U.S.C. 154(a)(2).

[21] Appl. No.: 08/960,791

[22] Filed: Oct. 30, 1997

[51] Int. Cl.[7] ..... B65D 85/00

[52] U.S. Cl. ..... 206/372; 206/373

[58] Field of Search ..... 206/327, 372, 206/373, 374, 375

[56] References Cited

U.S. PATENT DOCUMENTS 4,911,083 3/1990 Considine ..... 206/327
5,160,026 11/1992 Marsh ..... 206/373
5,301,829 4/1994 Chrisco ..... 206/373
5,370,263 12/1994 Brown ..... 206/373
5,544,744 8/1996 Oman ..... 206/372

*Primary Examiner*—S. Thomas Hughes
*Assistant Examiner*—Jermie E. Cozart
*Attorney, Agent, or Firm*—Julian Caplan; Flehr Hohbach Test Albritton & Herbert

[57] ABSTRACT

A tool tray formed with compartments for tools is adjustably longitudinally slidable in a casing or cover. The cover is closed on one side and open on the opposite side and end. The closed longitudinal edges extend outward; on one edge are split vertical holes to support sparkplugs; the opposite side has holes of several sizes into which screwdriver blades, wrench handles and the like may fit. The open side of the cover has transverse struts but there is access through the openings between struts for tools in the tray compartments. The closed side of the cover is recessed and formed in areas having raised edges so that tools may be placed therein for easy access. A latch located near the open end of the cover holds the tray in retracted position.

9 Claims, 6 Drawing Sheets

TOOL TRAY FOR AUTOMOTIVE REPAIR

CROSS REFERENCE TO RELATED PATENT

This invention constitutes an improvement over U.S. Pat. No. 5,160,026 issued Nov. 3, 1992, for ADJUSTABLE LENGTH TOOL BOX FOR AUTOMOBILE REPAIR INCLUDING A PIVOTAL LEG.

BACKGROUND OF THE INVENTION

1. Field of the Invention

This invention relates to a new and improved adjustable length tool box consisting of a tray and casing intended to be supported above an engine compartment. The tray is adjustably extendable from the casing so that the overall length of the components accommodates the length of the engine compartment of the particular vehicle with which it is being used. One end of the casing rests on the cowling of the vehicle or some other convenient location. The tray is pulled out from the casing a sufficient distance so that the forward end of the tray rests upon a portion of the front of the vehicle. Preferably a leg is pivoted to the forward end of the tray to rest upon the vehicle and supports the tray approximately horizontal.

2. Description of Related Art

The aforesaid U.S. Pat. No. 5,160,026 discloses a tool box which has a tray adjustably slidable forwardly of the casing and a pivoted leg to support the forward end approximately at the same elevation as the rearward end of the casing. The casing is formed with an opening on one side to provide access to the interior of the tray. The opposite side of the casing is closed so that when the casing is reversed relative to the tray the closed side of the casing closes off the upper, open side of the tray.

SUMMARY OF THE INVENTION

The present invention differs over U.S. Pat. No. 5,160,026 in a number of respects. The longitudinal side edges of the casing extend outward and are provided with openings. One of the openings provides a carrying handle for the device. Other openings, preferably of different sizes, support screwdrivers, wrenches and other tools which hang vertically therein. The opposite longitudinal side edge may be formed, if desired, with eight identical stepped openings to support sparkplugs or tools.

Another feature of the invention is that the forward end of the casing is formed with a hole which, in the closed position of the tray, is aligned with a spring-pressed detent on the tray which fits therein and holds the tray retracted within the casing. By pressing down on the detent and pulling the tray outwardly, the tray may be partially or totally removed from the casing. Locating the detent or latch for the tray at one end facilitates use of the device since the hand which is to pull the tray out of the casing is located in a position to release the detent.

Still another advantage of the present invention is the provision on the exterior of the closed side of the casing of compartments which prevent the tools laid therein from moving out of position, particularly if the casing is somewhat tilted from the horizontal.

A further feature of the invention is the construction of the casing. The casing is formed of two plastic molded halves which join at a horizontal plane extending longitudinally of the casing and approximately midway of its depth. The plastic molded halves are formed with trackways on which the tray slides.

Still another feature of the invention is the pivoting of the leg or foot plate at the forward end of the tray and the manner in which it is received in a recess on the underside of the tray when not in use.

The features of the invention set forth in said U.S. Pat. No. 5,160,026 are likewise maintained in the device hereinafter described.

DETAILED DESCRIPTION OF THE PREFERRED EMBODIMENT

Figure 1:
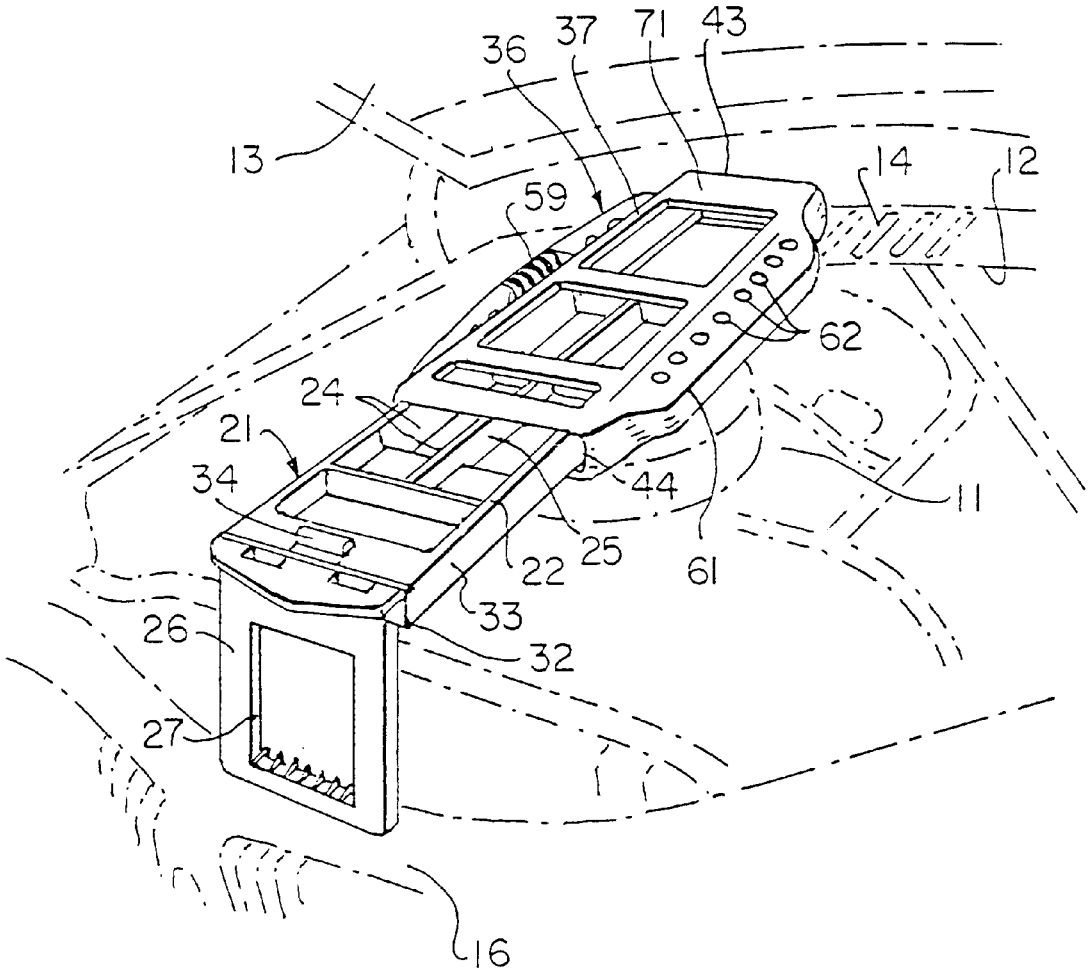
FIG. 1 is a perspective view showing the device installed in an engine compartment.
Figure 3:
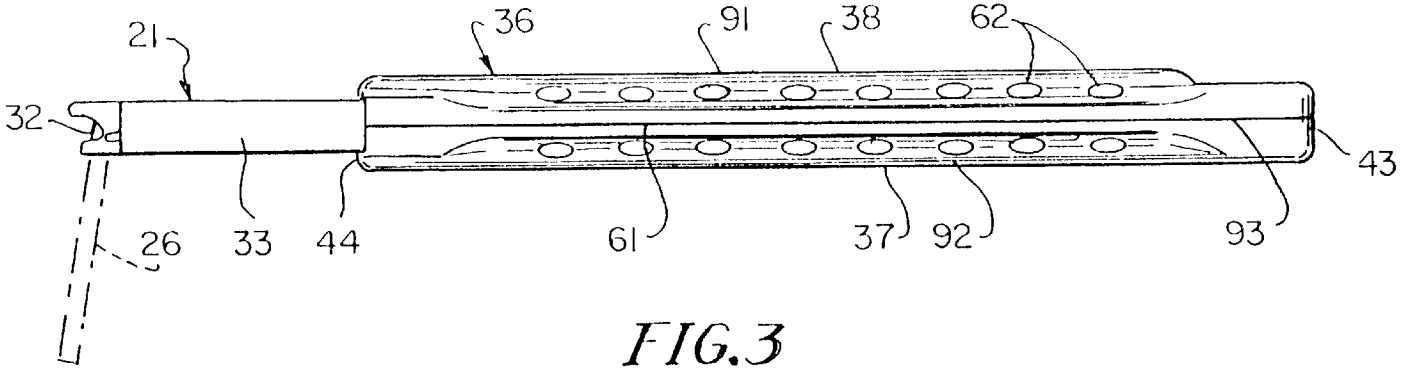
FIG. 3 is a side elevation of the structure of FIG. 2.
Figure 2:
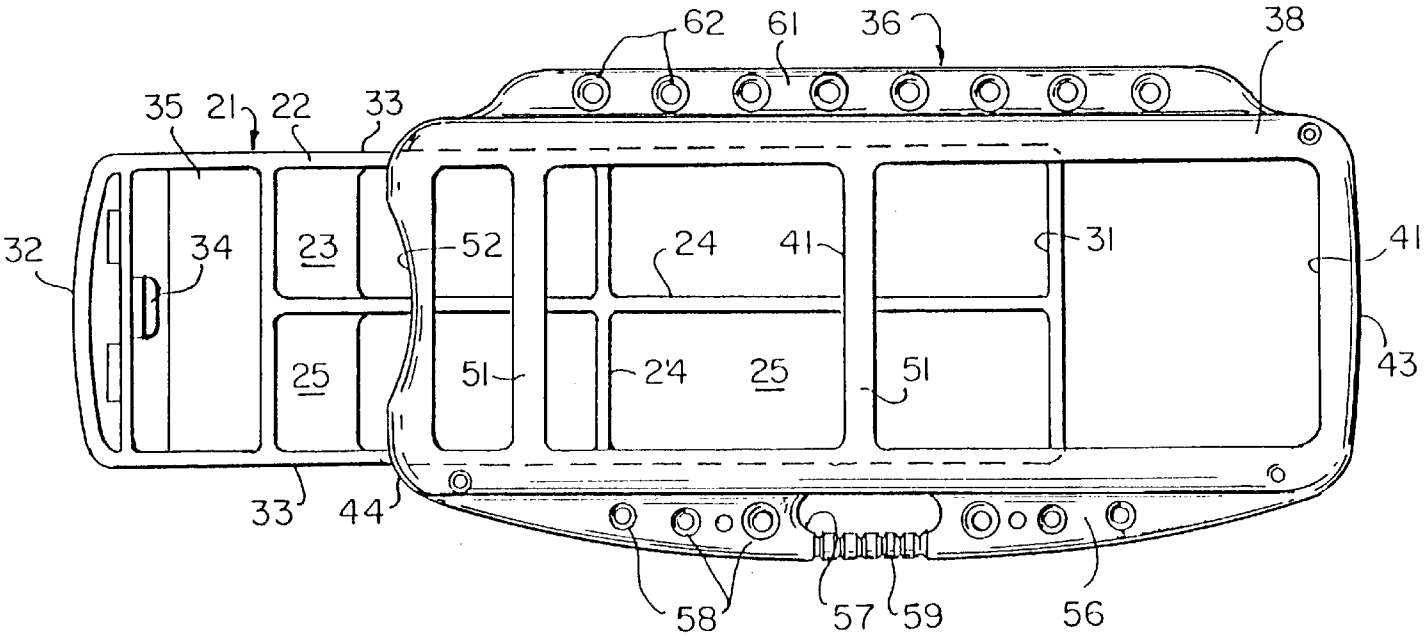
FIG. 2 is a top plan view thereof.
Figure 4:
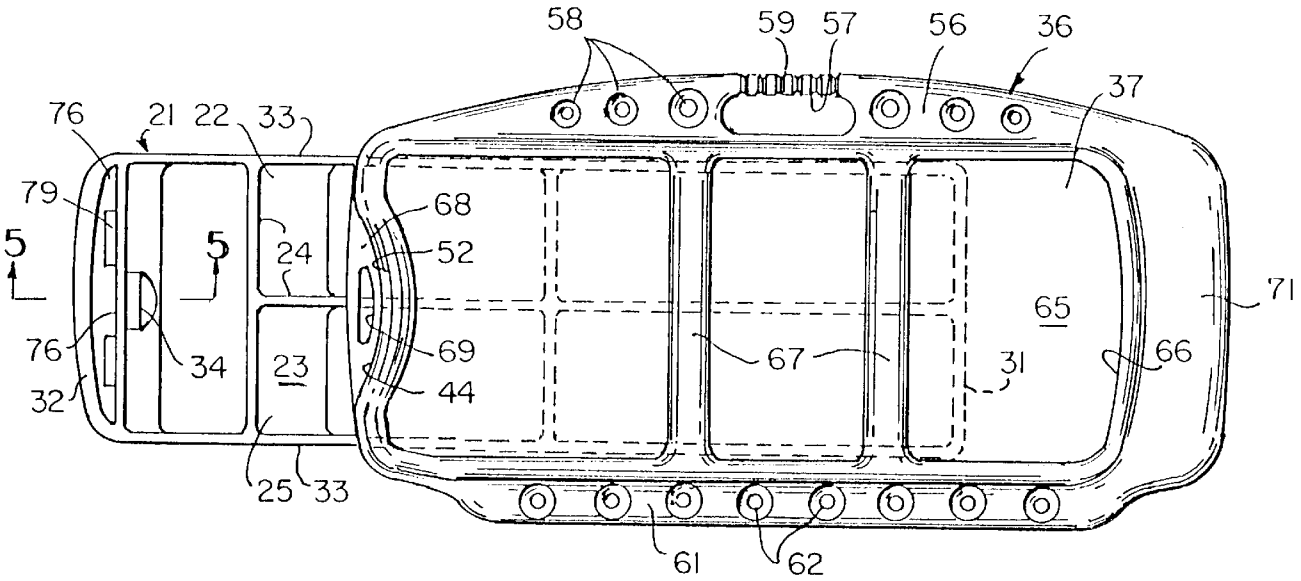
FIG. 4 is a view similar to FIG. 2 with the casing inverted and the tray withdrawn.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

A typical use for the present invention is in repairing an automobile engine 11 by supporting the device in engine compartment 12 with the hood 13 in open position. The rearward end 43 of casing 36 may rest on the cowling 14 which is a conventional part of an automobile or truck. The forward end 32 of tray 21 rests upon a ledge 16 at the forward end of compartment 12. The device is supported so that it is preferably substantially horizontal above the engine 11 and is therefore readily accessible to a mechanic working on the engine.

Tray 21 is substantially rectangular, having an open top 22 and a closed bottom 23, the space within tray 21 being formed with separators 24, the number and position of which is subject to considerable variation. The separators 24 divide the tray 21 into compartments 25 convenient for storing tools. Tray 21 has a closed rear end 31 and a forward end 32 interconnected by vertical sides 33. Latch projection 34 is spring-biased outwardly and, as here shown, is substantially rectangular in shape. A forward compartment 35 is of lesser depth than compartments 25.

Leg 26 is a substantially rectangular member preferably formed with a depression 27 to provide rigidity. At one end of leg 26 are raised members 76 (here shown as three in number) formed at their inner ends with transverse holes 77. To either side of holes 77 raised members 76 are formed with grooves 78. forward end 32 of tray 21 is formed with down-turned members 79 (here shown as two in number) and dimensioned to fit in the spaces between raised members 76. Members 79 are also formed with transverse holes (not shown). Hinge pin 81 fits through the aligned holes in members 76 and 78.

Figure 5:
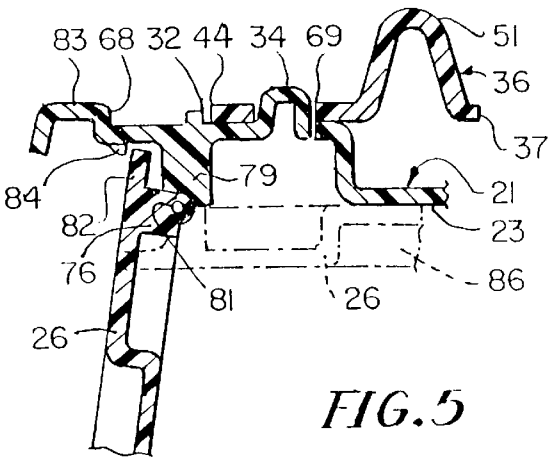
FIG. 5 is an enlarged fragmentary sectional view taken substantially along line 5—5 of FIG. 4.
Figure 6:
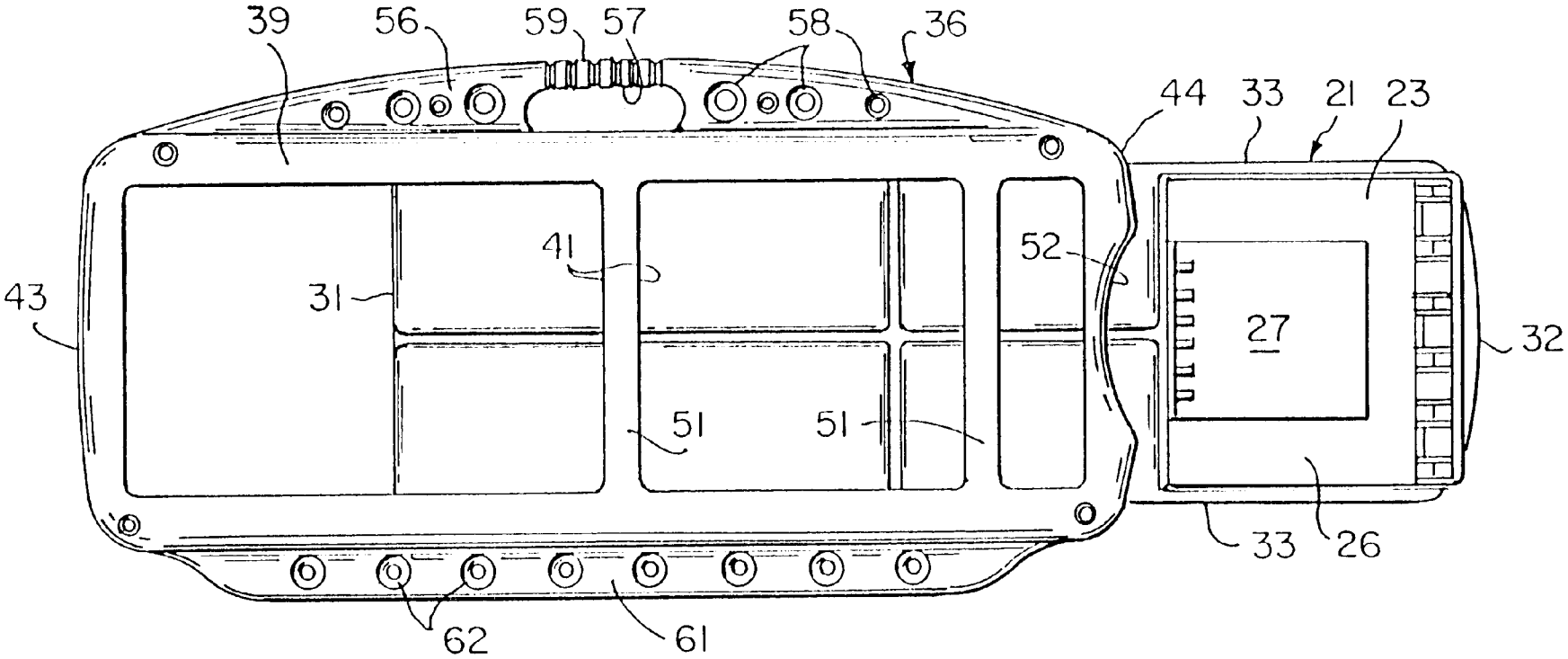
FIG. 6 is bottom plan view with the tray partially open.
Figure 7:
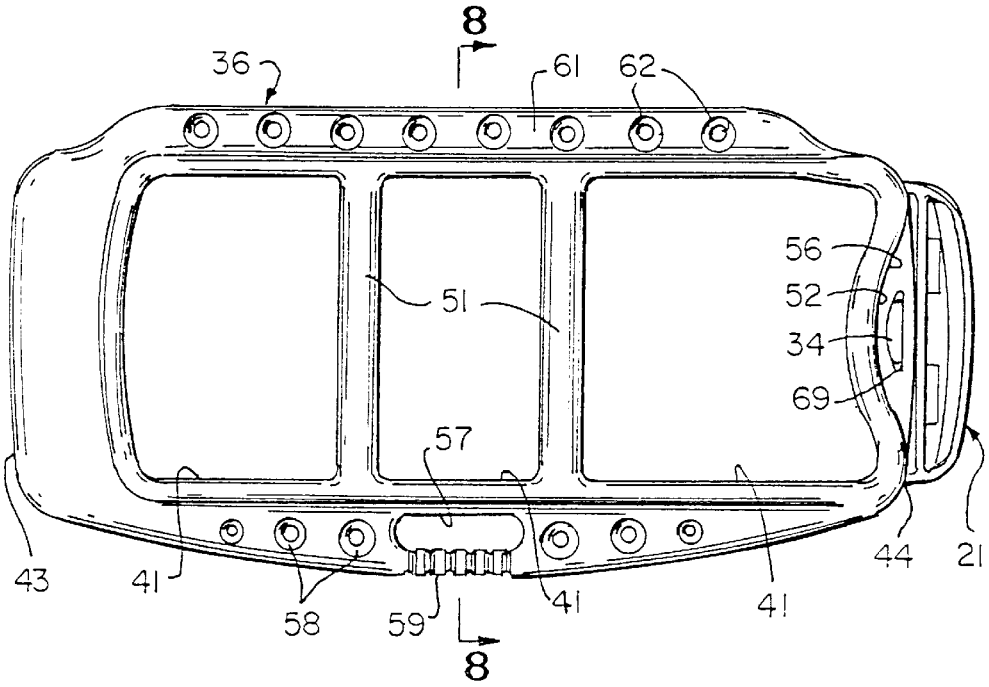
FIG. 7 is a view similar to FIG. 6 with the tray retracted.
Figure 8:
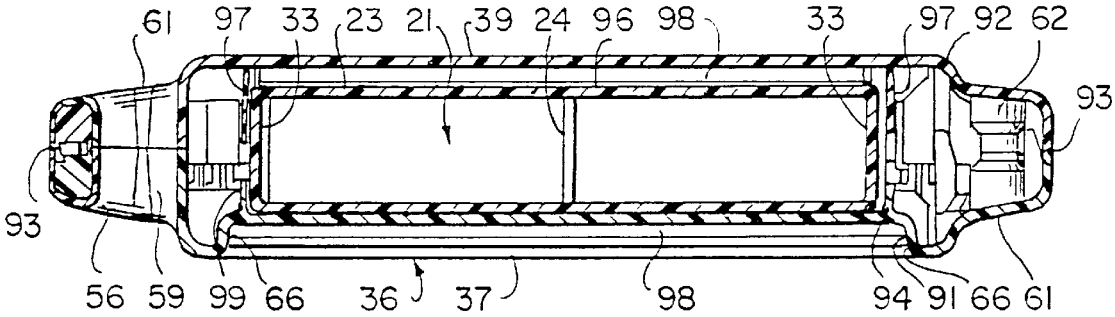
FIG. 8 is a sectional view taken substantially along line 8—8 of FIG. 7.
Figure 9:
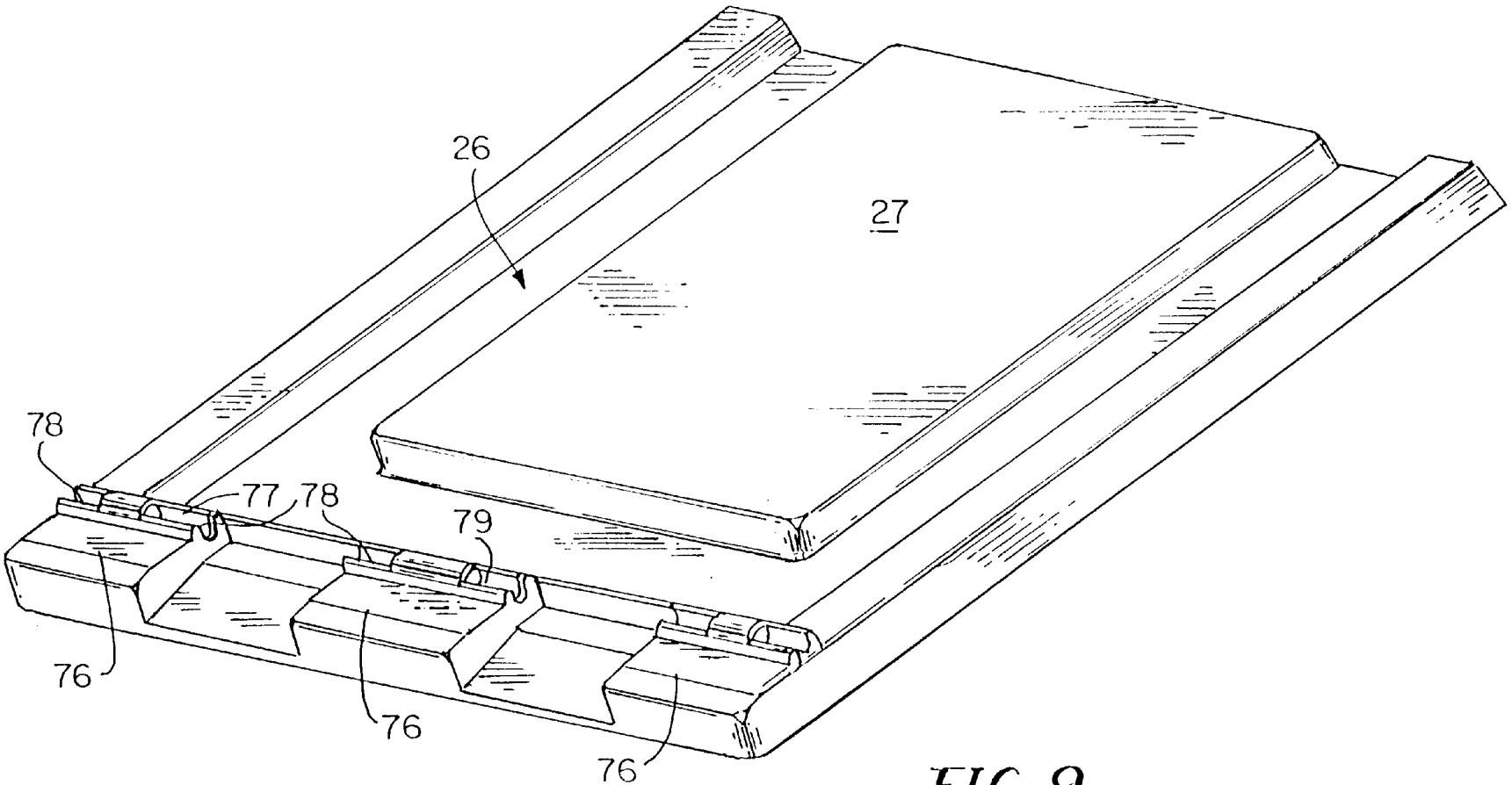
FIG. 9 is an enlarged perspective view of the tray.

In storage position leg 26 fits under tray 21 and the area 86 in the casing accommodates leg 26. To extend leg 26, tray 21 is pulled from casing 36 a sufficient distance so that leg 26 can pivot about pin 81 to down position. As best shown in FIG. 5, upper edge 82 of leg 26 is elevated above hinge pin 81. A forward extension 83 of tray 21 is formed with projection and is somewhat flexible. The underside of extension 83 is formed with a plurality of transversely spaced detents 84. When leg 26 moved to down position, upper edge 82 snaps over detents 84 and the leg is locked open. To retract leg 26, the user flexes extension 83 upward and pivots leg 26 counterclockwise to escape detents 84. The leg thus folds under tray 21 (see dot-and-dash position in FIG. 5).

Tray 21 is slidably received within casing 36. Casing 36 comprises top and bottom halves 91, 92 which meet at a horizontal joint 93 approximately midway of the depth of casing 36. Bottom half 92 is formed with a horizontal support 96 for tray bottom 23 and vertical edge guides 97 which engage tray sides 33. Top half 91 has a recessed bottom 98 for compartments 65 which engages the top of tray 21 and side guides 99 which engage tray sides 33. Thus tray 21 slides longitudinally within casing 36. The area 86 below support 96 accommodates leg 26 when in folded position. Casing 36 has a broad closed side 37 and an opposite open side 39, the latter being formed with openings 41. The rearward casing end 43 is closed and the forward casing end 44 is open for receipt of tray 21. Transverse spaced struts 51 are formed across open side 39 to reinforce the structure. The forward end 44 of side 39 is formed with a concave surface 52.

First side edge 56 of casing 36 bows outwardly and is formed centrally with a cut-out 57 which provides a handle 59 for carrying the casing. Cut-out 57 is formed in both casing halves. Throughgoing holes 58 of varying sizes may be formed in the extended side edge 56. Such holes are defined by cylindrical inserts in halves 91, 92. Tools may be suspended through the holes 58 for the convenience of the mechanic. Opposed second side edge 61 is also extended outwardly and may be formed with stepped holes 62, preferably eight in number, to accommodate sparkplugs to be installed or removed from the engine.

Closed side 37 is provided with raised edges 66 around its circumference and also one or more transverse raised projections 67 (here shown as two in number) thereby dividing side 37 into compartments 65 in which various tools may be laid while the mechanic is working on the engine. Open end 44 is formed with a reduced thickness portion 68 and portion 68 is formed with a hole 69 complementary to latch projection 34. Preferably a flat portion 71 is formed on the rear to rest on the cowling 14 or other position when the casing 36 is reversed from the position shown in FIG. 1.

When the device is used for transportation and storage, the tray 21 is installed inside casing 36 with the closed side 37 in contact with the open face of tray 21. This prevents tools within the tray 21 from being displaced from their original position. When the device is to be used for engine work, the user depresses latch projection 34 and pulls tray 21 outward so that projection 34 escapes from hole 69. The tray 21 may then be pulled partially or entirely out of the casing 36. If the closed side 37 of the casing 36 is to be positioned uppermost, then the amount which the tray 21 is pulled outwardly is sufficient so that the overall length of the device enables the user to support the rearward end 43 flat portion 71 on the cowling 14 or other position on the vehicle and the forward end 32 of tray 21 to rest on the top of the radiator of the vehicle or other satisfactory location.

If the open side 39 of casing 36 is to be uppermost, the user entirely removes the tray 21 from the casing 36 and then inverts the casing so that the open side 39 is uppermost. Thereupon the tray 21 is adjustably retracted within the open end 44 until the overall length of the device accommodates the available space in the engine compartment 12. The pivoted leg 26 may be used in the same manner as heretofore described. The openings between struts 51 provide access to the tray compartments 25.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. In a tool box having an elongated tray having parallel longitudinal tray sides, a first tray end, a second tray end and a tray bottom and a casing, said casing having an elongated casing top, an elongated casing bottom and casing sides higher than the depth of said tray, said tray being longitudinally slidable in relation to said casing, the extent of extension of said tray from said casing being adjustable, the improvement comprising said casing sides extending outward of said tray sides and at least one of said casing sides being formed with a plurality of throughgoing holes and one of said holes is longitudinally elongated to define a handle for carrying said tool box and at least one of said casing sides is formed with a plurality of holes to support tools and a second one of said casing sides extends outward of said tray side, said second side being formed with a plurality of second holes, said casing being formed of bottom and top halves joined at a plane approximately midway between the top and bottom of said casing, said bottom half having a support located above said casing bottom on which said tray bottom may slidably rest, said top half having a surface recessed below said casing top engaging the top of said tray, the distance between said casing sides being greater than the distance between said tray sides, at least one of said halves having side edge guides spaced inward of said casing sides and extending approximately parallel to said casing sides engaging said sides of said tray.

2. The improvement of claim 1 in which at least some of said second holes are shaped and dimensioned to support spark plugs.

3. The improvement of claim 1 in which said first tray end is formed with a resiliently biased latch projection and said casing forward end is formed with a hole to receive said projection to latch said tray within said casing.

4. The improvement according to claim 1 which further comprises cooperating latch means on said tray and one of said casing sides to latch said tray in a position substantially entirely within said casing.

5. In a tool box having an elongated tray having parallel longitudinal tray sides, a first tray end, a second tray end and a tray bottom and a casing, said casing having an elongated casing top, an elongated casing bottom and casing sides higher than the depth of said tray, said tray being longitudinally slidable in relation to said casing, the extent of extension of said tray from said casing being adjustable, the improvement comprising said casing sides extending outward of said tray sides and at least one of said casing sides being formed with a plurality of throughgoing holes and one of said holes is longitudinally elongated to define a handle for carrying said tool box and at least one of said casing sides is formed with a plurality of holes to support tools and a second one of said casing sides extends outward of said tray side, said second side being formed with a plurality of second holes, a leg to support said first tray end, said leg having at least three transversely spaced first members, said first members being formed with first holes, said first tray end being formed with at least two members shaped to fit between said first members, said second members being formed with second holes aligned with said first holes and hinge pins passing through said first and second holes, said leg being pivotable about said hinge pins between closed and open positions.

6. The improvement of claim 5 which further comprises detents on said tray to resiliently engage said leg when in open position.

7. The improvement according to claim 1 in which said leg is permanently secured to said tray bottom.

8. The improvement according to claim 7 in which said leg has a forward portion which extends beyond said tray when said tray is in closed position and which further comprises first latch means on said forward portion and cooperating second latch means on said tray to latch said leg in open position.

9. The improvement according to claim 8 in which said tray bottom is formed with a recess on its underside to receive said leg when in closed position.

* * * * *